United States Patent [19]

Przybylinski et al.

[11] 4,177,736

[45] Dec. 11, 1979

[54] MECHANICALLY AND WELDINGLY SECURED BRACKET

[75] Inventors: Phillip G. Przybylinski, Schererville; Babgaunda A. Patil, Hammond, both of Ind.; George S. McNally, South Holland, Ill.

[73] Assignee: Pullman Incorporated, Chicago, Ill.

[21] Appl. No.: 855,518

[22] Filed: Nov. 28, 1977

[51] Int. Cl.[2] ..... B61D 17/16; B61D 39/00; E04B 7/16; E04D 13/14

[52] U.S. Cl. ..... 105/377; 52/19; 105/411

[58] Field of Search ..... 214/64.2; 52/19; 105/377, 411

[56] References Cited

U.S. PATENT DOCUMENTS

| | | | |
|---|---|---|---|
| 957,252 | 5/1910 | Posson | 105/377 X |
| 1,374,299 | 4/1921 | Hawksworth | 105/377 |
| 2,309,237 | 1/1943 | Campbell | 105/377 |
| 2,433,084 | 12/1947 | Beauchamp | 105/377 |
| 3,090,160 | 5/1963 | Shaver et al. | 105/377 X |
| 3,259,078 | 7/1966 | Radey et al. | 105/377 |
| 3,833,135 | 9/1974 | Larsen | 214/64.2 |

*Primary Examiner*—Stephen G. Kunin
*Assistant Examiner*—Howard Beltran
*Attorney, Agent, or Firm*—Richard J. Myers

[57] ABSTRACT

A reinforcing member for inhibiting failure caused by metal fatigue in the walls of the hatch coaming in a covered hopper car. The reinforcing member utilizes the combination of a weld and a mechanical connection to provide a reinforcement which effectively resists both axial loading and bending moments that cause fatigue failure.

7 Claims, 4 Drawing Figures

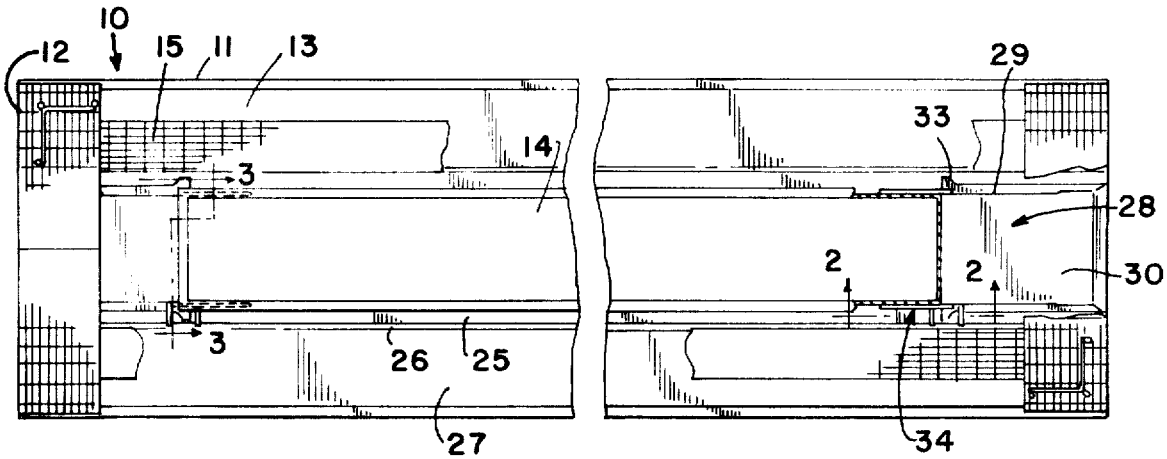
FIG. 1.
FIG. 2.
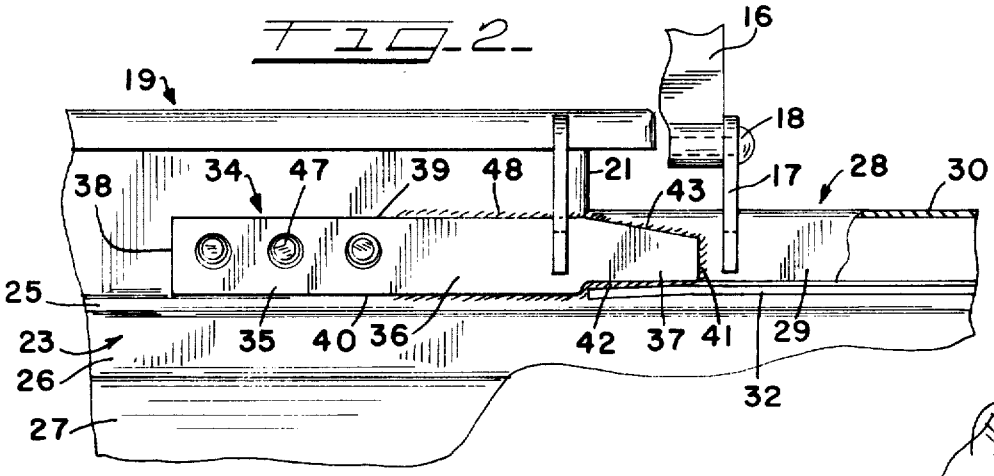
FIG. 3.
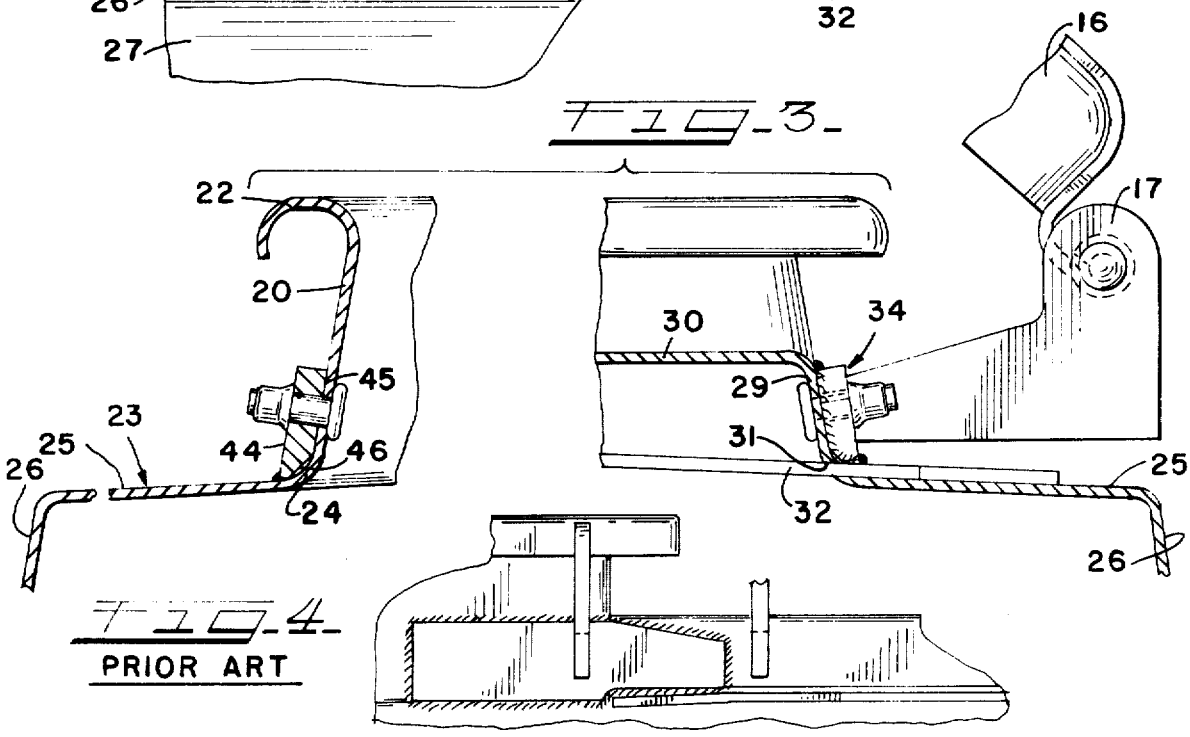
FIG. 4.
PRIOR ART

MECHANICALLY AND WELDINGLY SECURED BRACKET

BACKGROUND OF THE INVENTION

1. Field of the Invention

The present invention relates to covered hopper cars that have elongated generally rectangular hatch openings extending substantially the length of the roof. More particularly, the invention relates to a reinforcing member for inhibiting fatigue failure of the hatch coaming that extends about the periphery of the hatch opening.

2. Description of the Prior Art

The prior art includes U.S. Pat. Nos. 3,090,160 and 3,833,135 which show various stiffening structures utilized on railway vehicles. U.S. Pat. Nos. 2,309,237 and 2,433,084 show hatch arrangements utilized on railway vehicles. The prior art also includes a reinforcing member used on certain covered hopper cars built by the applicants' assignor, Pullman Standard Division of Pullman Incorporated. As best shown in FIG. 4, in this Pullman Standard design the reinforcing member is shorter and is welded about its entire periphery. Thus the weld termination and termination of the reinforcing member coincide. In this particular design, due to the length of the car, high levels of loading were not encountered and fatigue failure of the coaming did not present a problem.

SUMMARY OF THE INVENTION

A typical covered hopper car has a generally rectangular elongated hatch opening in its roof with one or more hatch covers hingedly connected at the side of the opening for covering the opening. The hatch opening is defined by upstanding coaming which extends about the longitudinal and transverse edges of the openings. At each corner of the hatch opening reinforcing members are utilized to tie or splice the longitudinal coaming side wall to the adjacent wall of the end closure section. The end closure section abuts the transverse coaming end wall and extends to the end of the car.

The coaming is subjected to significant loading from various sources. For example, during operation of the vehicle twisting tends to occur about the longitudinal axis of the car. Such twisting results in bending moments and axial loads being transmitted to the walls of the coaming. Due to the cyclical nature of the loading, the walls of the coaming are alternately placed in compression and tension. In addition during operation axial loading due to car impacts is also possible. Under such conditions, fatigue failure, especially at the corners of the coaming can occur.

Each reinforcing member has an intermediate portion and an end portion which is welded to the walls of the coaming and end closure section respectively. In the area of greatest axial loading, each member has an inner end portion attached to the coaming side wall by mechanical fasteners such as rivets or bolts. This in effect shifts the weld termination to an area of lower stress remote from the termination of the reinforcing member. The mechanical termination exhibits greater fatigue resistance while retaining the benefit of the load carrying capacity of a welded member.

BRIEF DESCRIPTION OF THE DRAWINGS

FIG. 1 is a top plan view of a covered hopper car;

FIG. 2 is a side elevation view of the reinforcing bar taken substantially along line 2—2 of FIG. 1;

FIG. 3 is a cross sectional view of the reinforcing bars taken substantially along line 3—3 of FIG. 1;

FIG. 4 shows the prior art reinforcing member.

DESCRIPTION OF THE PREFERRED EMBODIMENT

Referring particularly to FIG. 1, a railway covered hopper car 10 includes sides 11, ends 12 and a roof 13 with a generally rectangular elongated trough hatch opening 14. The roof 13 is provided with conventional walkways or running boards 15. One or more hatch covers 16 are positioned on the roof 13. The hatch cover 16 is rotatably mounted on hinge brackets 17 through the use of hinge bolts 18.

Coaming 19 extends about the periphery of the trough hatch opening 14. The coaming has a pair of longitudinally extending generally upright side walls 20 and a pair of transversely extending generally upright end walls 21 which define the hatch opening 14. At its upper edge the coaming has an arcuate or rounded flange 22. At their lower edges the coaming side walls 20 are connected to roof sheets 23 by rounded bend portions 24.

Each roof sheet 23 has a first outwardly extending portion 25 and a generally vertical portion 26 forming a step. The roof sheet has a second portion 27 extending outwardly from the lower edge of the generally vertical portion 26 to the side 11 of the car.

At each end of the trough hatch opening 14, abutting the transversely extending end wall 21 and extending longitudinally to the end 12 of the car is an end closure section generally designated 28. The end closure section 28 includes a downwardly facing channel with flanges or walls 29 and a horizontally extending upper web portion 30 connecting the flanges. Each flange or wall 29 is coplanar with one of the coaming side walls 20.

The lower free edges 31 of the walls of the channel portion are attached to the bottom closure plate 32 which is attached to the roof sheet portion 25. At the end adjacent to the coaming end wall 21 the bottom closure plate 32 has a pair of outwardly extending tabs 33 and longitudinal edges 33*a* which are integrally connected to the first outwardly extending portion of the roof sheet 25. The tabs 33 aid in transferring loading away from the corners of the coaming.

As best shown in FIG. 2 a reinforcing member 34 has an inner end portion 35, an intermediate portion 36, and an outer end portion 37. The intermediate and outer end portions, 36 and 37 are attached or secured by rigid securement means or first attachment means comprising a weld. More specifically, the intermediate portion 36 is welded to the coaming side wall at its upper edge 39 and welded to the first outwardly extending portion 25 of the roof sheet at its lower edge 40. The outer end portion 37 is welded to the adjacent coplanar wall 29 of the end closure section 28. The inner end portion 35 is secured or attached to the coaming side wall 20 by mechanical securement means such as a bolt or rivet 47. As used herein the term mechanical connection excludes a weld.

The outer end portion 37 is diagonally sheared lengthwise of the member 34 and is downwardly tapered along its upper edge 43. The outer end portion 37 terminates in a vertical edge 41 and is notched at its lower edge 42 to accommodate the outwardly extending bottom closure plate 32.

The diagonal upper edge 43 accommodates a longer weld along this edge and decreases the weld length along vertical edge 41.

As best shown in FIG. 3 the reinforcing member 34 has a first or external surface 44 and a second or internal surface 45. A beveled corner forming a surface 46 extends diagonally widthwise of the member 34 from the internal surface 45 to the lower edge 40. When the reinforcing member is in the installed position the surface 45 extends from the coaming side wall 20 to the first outwardly extending portion 25 of the roof sheet 23.

The reinforcing member 34 ties or splices the side wall 20 of the coaming to the adjacent wall of the end closure section 29. During operation vehicle twisting occurs about the longitudinal axis of the car, resulting in bending moments and axial loading on the side and end walls of the coaming. The cyclical nature of the twisting results in the walls of the coaming being alternately placed in compression and tension. By providing a mechanical connection such as a bolt or rivet at the inner end 35 of the reinforcing member 34, the weld termination is shifted to an area of lower stress. This increases the fatigue resistance of the coaming by obviating the development of stress concentrations which lead to cracking or fracturing of the coaming side wall proximate the termination of the reinforcing member while retaining the load carrying capability of a welded member.

The foregoing drawings and description merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. In a railway hopper car having sides, ends and a roof including coaming defining a hatch opening;

said coaming having a pair of longitudinally extending side walls and a pair of transversely extending end walls intersecting to define corners;

end closure sections abutting each of the transversely extending end walls, the improvement comprising:

a reinforcing member at each corner connecting the coaming to the end closure section;

said reinforcing member including inner, intermediate and outer end portions; and said reinforcing member having mechanical securement means attaching the inner end portion to the coaming; and said reinforcing member having a rigid securement comprising weld means spaced from said mechanical securement attaching the intermediate portion to the coaming and attaching the outer end portion to the end closure section thereby mitigating stress concentrations leading to fracturing of the coaming during operation of the railway car.

2. The invention according to claim 1, and said end closure sections each including a pair of transversely spaced walls, each of said walls being essentially coplanar with one of the side walls of the coaming;

said hopper car roof including a roof sheet extending outwardly from said coaming side wall and said end closure section wall;

said intermediate portion and said outer end portion having upper and lower edges;

said weld means attaching the upper and lower edges of the intermediate portion of the reinforcing member to the coaming side wall and roof sheet respectively;

said weld means attaching the upper and lower edges of the outer end portion of the reinforcing member to the end closure section wall and roof sheet respectively, and said inner end portion being fastened to said coaming side wall by said mechanical securement means.

3. The invention according to claim 2, and each of said end closure sections including a bottom closure plate having longitudinal edges and extending from the coaming end wall to each end of the car;

said transversely spaced end closure walls extending upwardly from the bottom closure plate and being spaced inwardly of the edges of the bottom closure plate.

4. The invention according to claim 3, and said bottom closure plate including outwardly extending tabs at the end abutting the coaming end wall;

said tabs being welded to respective roof sheets.

5. The invention according to claim 3, and said outer end portion terminating in a vertical edge and said vertical edge being attached to the end closure wall by a weld.

6. The invention according to claim 3, and said outer end portion of said reinforcing member being downwardly tapered at its upper edge and being notched at its lower edge to accommodate said bottom closure plate.

7. The invention according to claim 6, and said reinforcing member having internal and external surfaces;

said reinforcing member having a beveled surface extending from the internal surface to the lower edges of the reinforcing member.

* * * * *